US011305934B2

(12) United States Patent
Gause

(10) Patent No.: US 11,305,934 B2
(45) Date of Patent: Apr. 19, 2022

(54) WASTE/RECYCLING RECEPTACLE PROTECTOR/MONITOR

(71) Applicant: Marshall Gause, Thornton, CO (US)

(72) Inventor: Marshall Gause, Thornton, CO (US)

( * ) Notice: Subject to any disclaimer, the term of this patent is extended or adjusted under 35 U.S.C. 154(b) by 0 days.

(21) Appl. No.: 17/235,114

(22) Filed: Apr. 20, 2021

(65) Prior Publication Data

US 2021/0339947 A1 Nov. 4, 2021

(51) Int. Cl.
*B65F 1/00* (2006.01)
*B65F 1/16* (2006.01)

(52) U.S. Cl.
CPC ..... *B65F 1/1615* (2013.01); *B65F 2210/108* (2013.01); *B65F 2210/128* (2013.01); *B65F 2210/148* (2013.01); *B65F 2210/165* (2013.01); *B65F 2210/168* (2013.01)

(58) Field of Classification Search
None
See application file for complete search history.

(56) References Cited

U.S. PATENT DOCUMENTS

| | | | | |
|---|---|---|---|---|
| 3,363,924 | A * | 1/1968 | Remig | B65F 1/1615 292/258 |
| 3,674,298 | A * | 7/1972 | Vekony | B65D 45/02 292/258 |
| 3,731,964 | A * | 5/1973 | Hyde | B65F 1/1615 292/258 |
| 6,230,920 | B1 * | 5/2001 | Porter | B65F 1/1615 220/225 |
| 6,722,709 | B2 * | 4/2004 | Bergdoll | B65F 1/1615 292/1 |
| 10,614,475 | B2 * | 4/2020 | Frybarger | B65F 1/00 |
| 10,889,437 | B1 * | 1/2021 | Altadonna, Jr. | B65F 1/1468 |

* cited by examiner

*Primary Examiner* — Kavel Singh

(57) ABSTRACT

The present disclosure provides a waste/recycling receptacle protector/monitor for obtaining at least one objective for an individual. The waste/recycling receptacle protector/monitor includes a tension adjustable fastening module. The tension adjustable fastening module has first and second opposing ends that adapt to extend along at least one direction of a lid of a waste/recycling receptacle. The tension adjustable fastening module breaks apart under a predetermined opposable force preset by the individual. The at least one objective includes protection against at least one of theft of the waste/recycling receptacle, natural climate, personal data theft, and unauthorized dumping into the waste/recycling receptacle and surveillance of vicinity and one or more objects around the waste/recycling receptacle.

8 Claims, 7 Drawing Sheets

100

WASTE/RECYCLING RECEPTACLE PROTECTOR/MONITOR

TECHNICAL FIELD

The present invention relates to the field of waste/recycling receptacle, in particular, relates to securing the waste/recycling receptacle using a waste/recycling receptacle protector/monitor.

BACKGROUND

A major concern for both the home and the commercial place is to contain and hold wastes, refuse, and trash until permanent disposal. Receptacles and other devices act as containers for holding trash and other wastes that are produced in any typical home or commercial place. Receptacles, Trash and garbage cans, and other devices often employ lids and covers to contain the trash and its associated odor, to hide the trash from view, and to prevent the trash from contaminating areas beyond the lid.

Receptacles and other devices having lids or doors are used in a variety of different settings. For example, in both residential and commercial settings, trash cans and other devices often have lids or doors for protecting or preventing the escape of the contents of the receptacle. In the context of trash cans, some trash cans include lids or doors to prevent odors from escaping and to hide the trash within the receptacle from view. Additionally, the lid of a trash may help to prevent contamination from escaping from the receptacle.

Waste containers, even when they include a lid, are susceptible to having the lid dislodged during inclement weather, by animals seeking food, and during any number of other occurrences. Even lids that fit snugly over the upper end of waste containers may be dislodged by animals seeking food or during inclement weather.

Lids which are not pivoted or tethered to the garbage can often do not fit the top of the garbage can after time or after having been crushed by traffic on the road before the garbage can and lid are retrieved from the roadside by the homeowner. Efforts have been made to permanently tether the lid to the can by a pivot joint or by a flexible tether. However, tethered or pivotable lids with hinges require complicated buckles or other fasteners, and interfere with the sanitation worker's swift lifting and inverting the garbage can's refuse contents into the garbage truck bin. An attached hinged lid could move against the sanitation worker's arm or hands, and interfere with dumping, or worse, could spring back and hit the sanitation worker in the face or eyes while dumping the refuse contents into the bin of the garbage truck.

An example of wind or rain damage and stress is in the event of high winds and or rain when the receptacle waste or recycling needs to be placed outdoors on the street for pick-up by the sanitation department or private contractor early the next morning. The lids of the garbage can be blown open and the items inside are blown across public and private areas causing possibly the loss of personal data and or cause property damage or personal injury. Straps used to hold down the lid must be manually removed and contain no advanced electronics or innovations.

In light of the foregoing discussion, there exists a need for a waste/recycling receptacle protector/monitor which overcomes the above-cited drawbacks.

SUMMARY

In an aspect, the present disclosure provides a waste/recycling receptacle protector/monitor for obtaining at least one objective for an individual. The waste/recycling receptacle protector/monitor includes a tension adjustable fastening module. In addition, the tension adjustable fastening module has first and second opposing ends that adapt to extend along at least one direction of a lid of a waste/recycling receptacle. Further, the tension adjustable fastening module breaks apart under a predetermined opposable force preset by the individual.

In an embodiment of the present disclosure, the at least one objective includes protection against at least one of theft of the waste/recycling receptacle, natural climate, personal data theft, and unauthorized dumping into the waste/recycling receptacle and surveillance of vicinity and one or more objects around the waste/recycling receptacle.

In an embodiment of the present disclosure, the waste/recycling receptacle includes a container body, the lid connected to the container body through one or more mechanical means, and an engagement member on an outer surface of the container body or the lid to engage with the tension adjustable fastening module.

In an embodiment of the present disclosure, the tension adjustable fastening module includes a retaining latch and a securing mechanism constructed and arranged to secure the retaining latch and at least one strap to the lid. In addition, the retaining latch has the at least one strap at first and second opposing ends of the retaining latch. Further, the retaining latch may be configured for selectively setting between a manual mode, a semi-automatic mode or an automatic mode. Furthermore, the retaining latch includes a first fastener attached to the first end of the at least one strap of the tension adjustable fastening module and a second fastener attached to the second end of the at least one strap of the tension adjustable fastening module. Moreover, the first fastener being matingly engageable with the second fastener. The securing mechanism is governed by the predetermined opposable force preset by the individual. Also, the tension adjustable fastening module is constructed and arranged to maintain the lid in a closed position and the first fastener and the second fastener are matingly engaged with each other in a first engaged position, and to release the lid from the closed position when the first fastener and the second fastener are in a second non-engaged position. The primary function of the tension adjustable fastening module is to break apart with the predetermined opposable force preset by the individual to allow the trash lid to open by releasing the retaining strap.

In an embodiment of the present disclosure, the waste/recycling receptacle protector/monitor may include one or more thermal cameras, one or more day imagers, a plurality of sensors, a processor, and a memory. In addition, the memory comprises instructions configured to cause the processor to obtain the at least one objective for the individual. Further, the tension adjustable fastening module, the one or more thermal cameras, the one or more day imagers and the plurality of sensors are coupled with the processor and the memory. Furthermore, the processor, the one or more thermal cameras, the one or more day imagers, and the plurality of sensors are located inside or around the waste/recycling receptacle. Moreover, the one or more thermal cameras include at least one of cooled thermal cameras and uncooled thermal cameras. Also, the one or more day imagers include at least one of coloured cameras, omnidirectional cameras, and pan-tilt-zoom cameras. Also, the plurality of sensors includes at least one of one or more tension sensors to release the retaining latch, one or more GPS sensors, one or more accelerometer sensors, one or more magnetometer sensors, one or more gyroscope sensors, one or more barometer sensors, one or more proximity sensors, one or more motion sensors, one or more microphones, one or more weather sensors, one or more thermal sensors, one or more wireless fidelity sensors, and one or more image sensors.

In an embodiment of the present disclosure, the waste/recycling receptacle protector/monitor may be configured to connect with a communication device of the individual.

In an embodiment of the present disclosure, the waste/recycling receptacle protector/monitor may include a power supply to run one or more electronic and electric modules located inside or around the waste/recycling receptacle.

In an embodiment of the present disclosure, the waste/recycling receptacle protector/monitor may be operated through at least one of a touch screen installed on the waste/recycling receptacle, a keypad installed on the waste/recycling receptacle or remotely using the communication device of the individual.

BRIEF DESCRIPTION OF THE DRAWINGS

Figure 1:
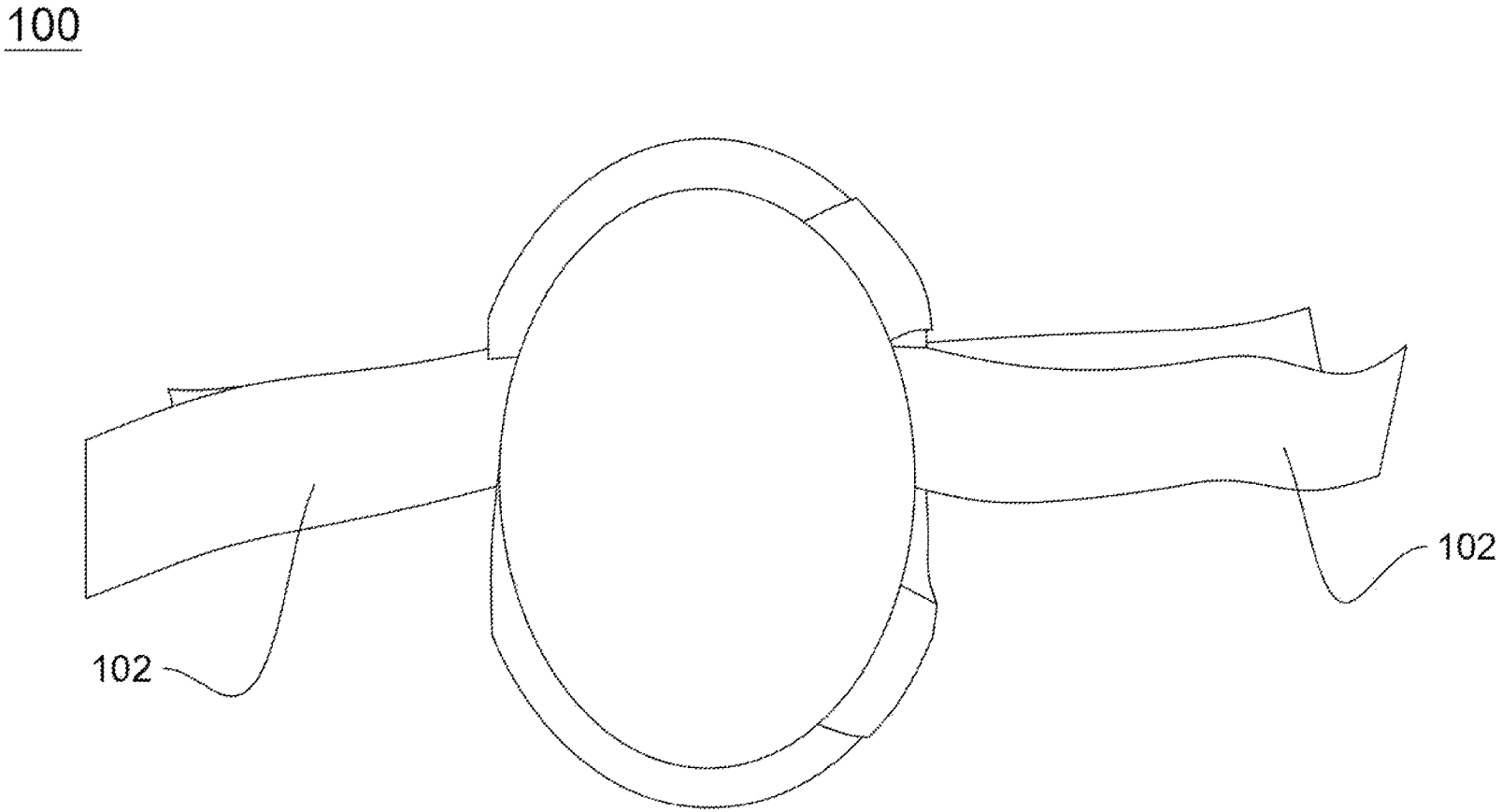
Figure 2:
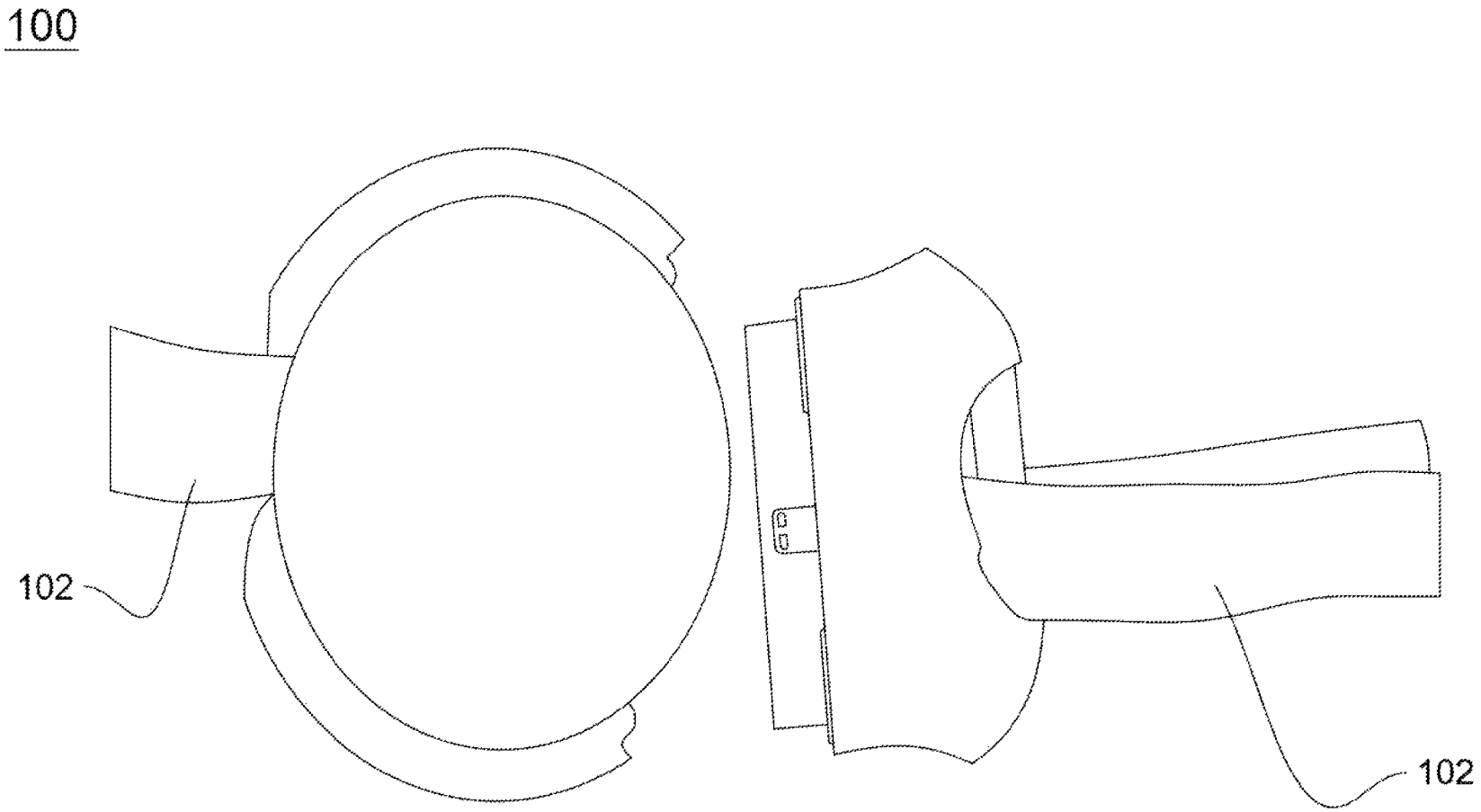
Figure 3:
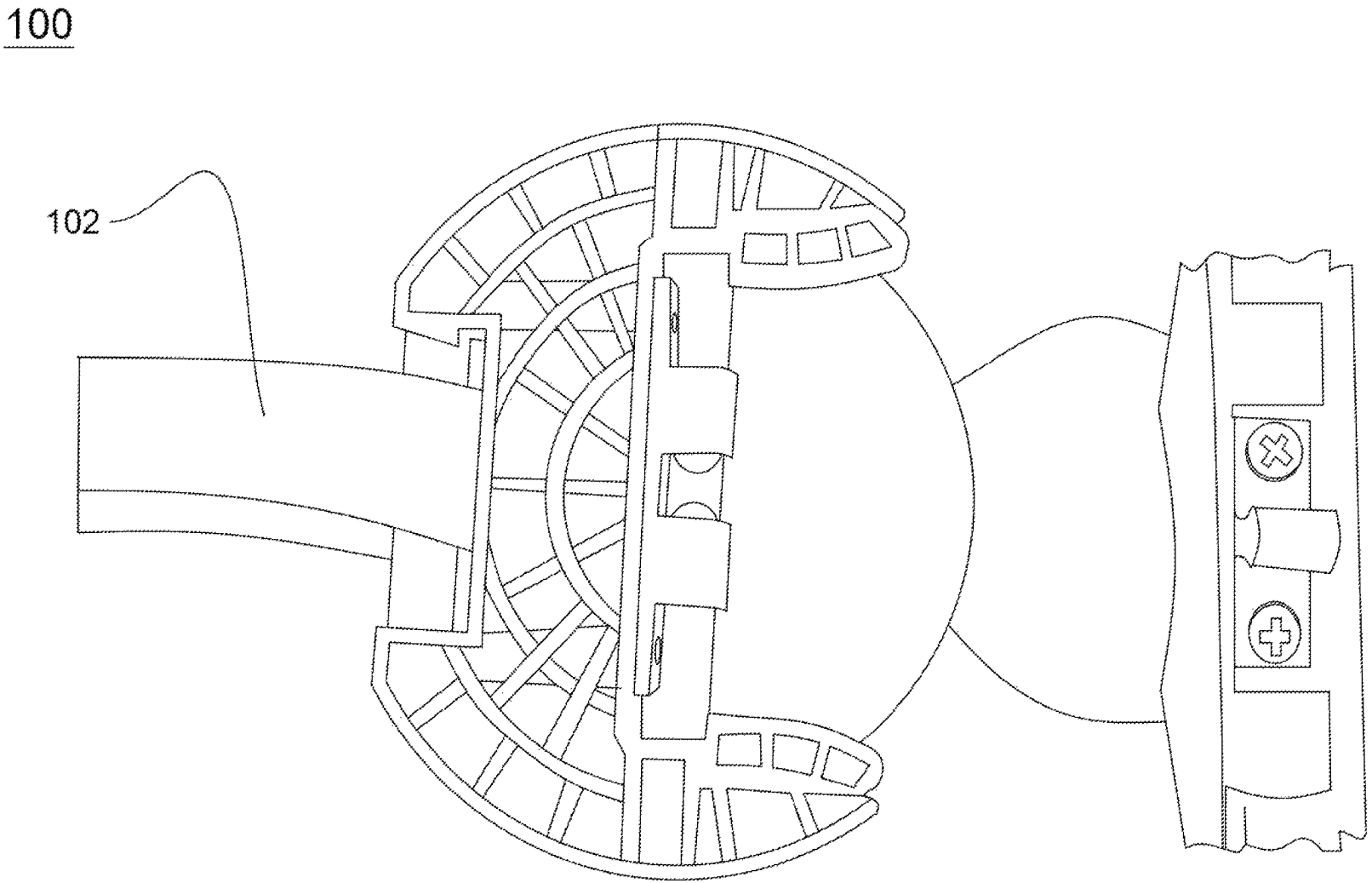
Figure 4:
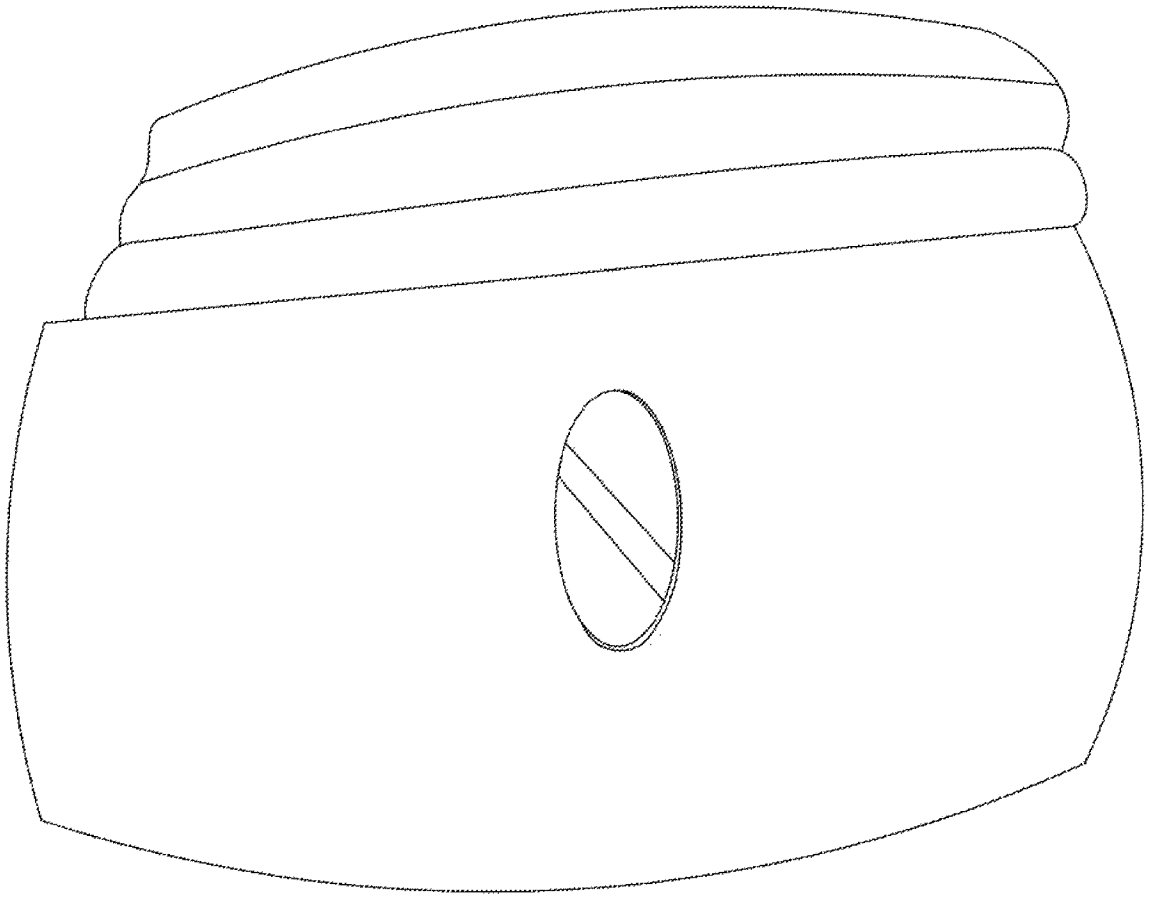
Figure 5:
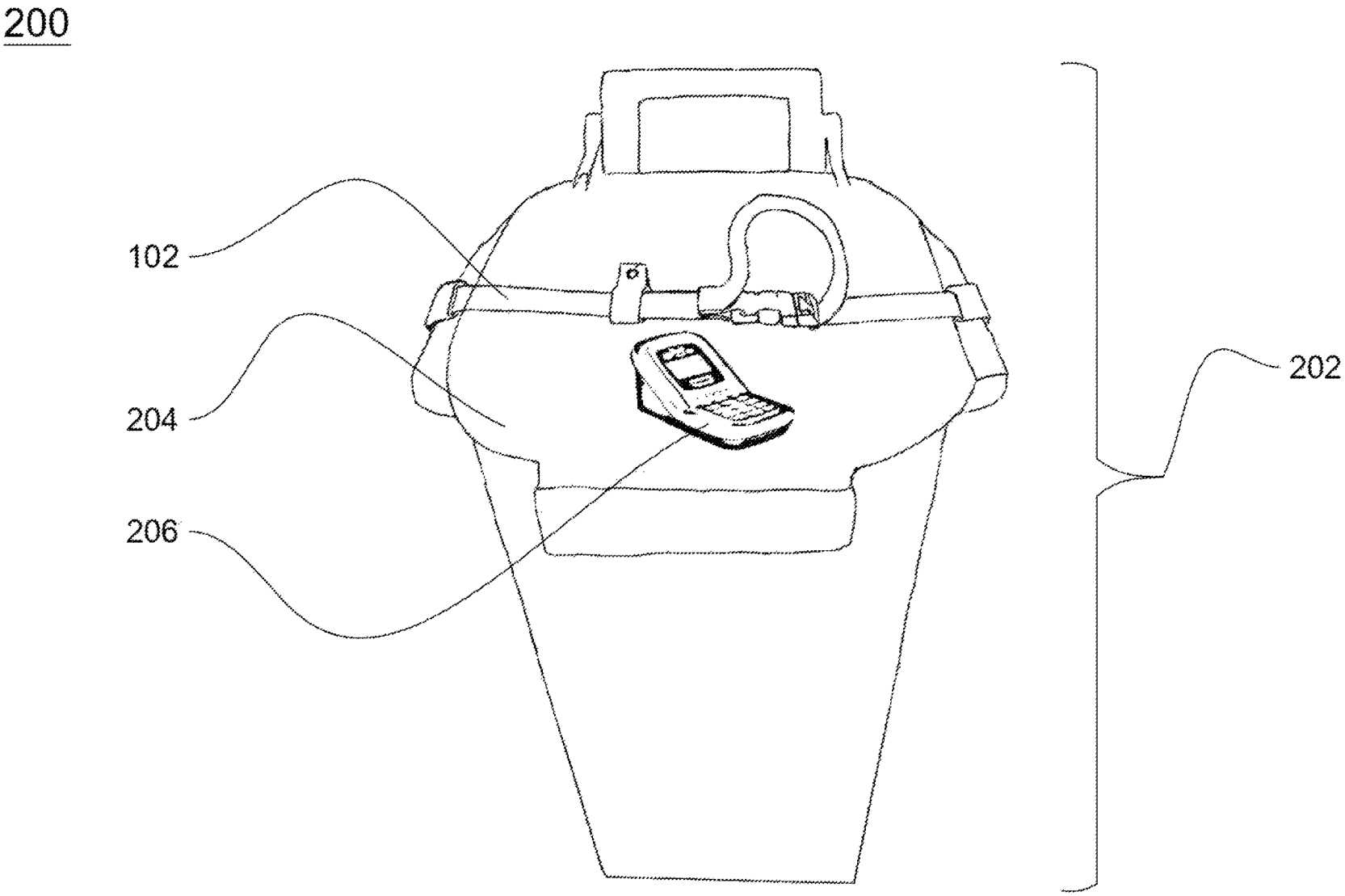
Figure 6:
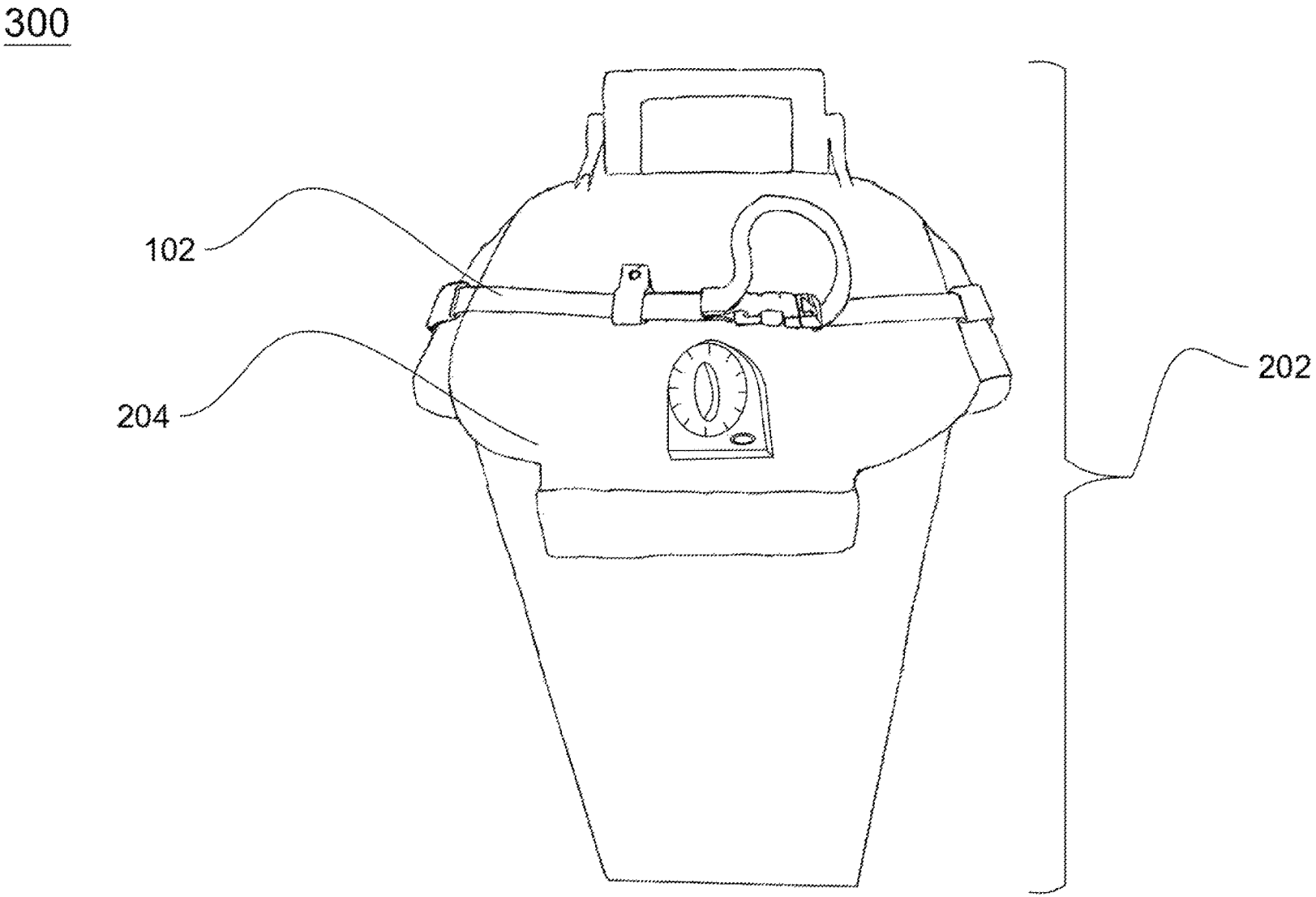
Figure 7:
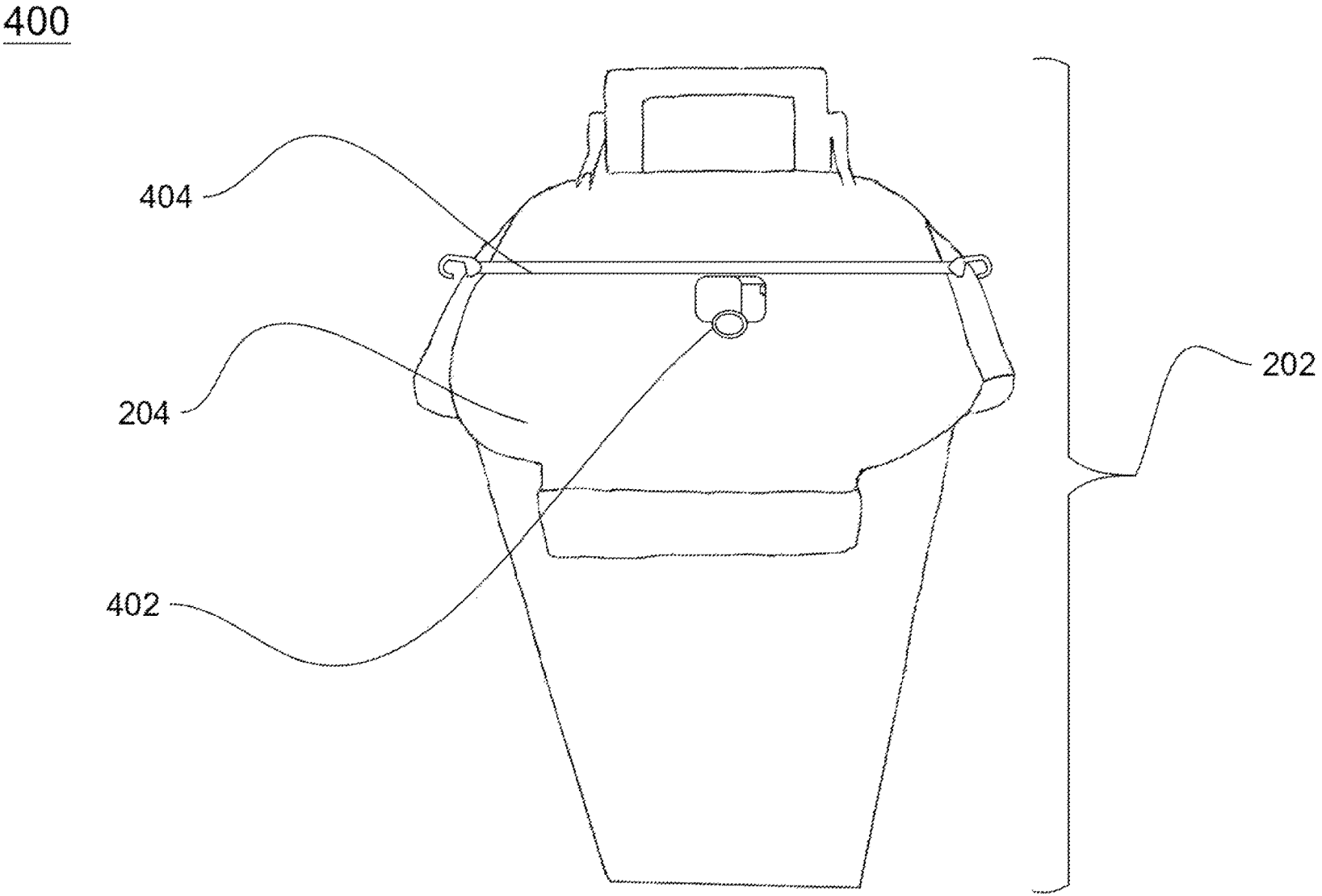

Having thus described the invention in general terms, reference will now be made to the accompanying drawings, which are not necessarily drawn to scale, and wherein:

FIG. 1 illustrates a first perspective view of a fastening module to obtain at least one objective for an individual, in accordance with various embodiment of the present disclosure;

FIG. 2 illustrates a second perspective view of the fastening module to obtain the at least one objective for the individual, in accordance with various embodiment of the present disclosure;

FIG. 3 illustrates a third perspective view of the fastening module to obtain the at least one objective for the individual, in accordance with various embodiment of the present disclosure;

FIG. 4 illustrates a fourth perspective view of the fastening module to obtain the at least one objective for the individual, in accordance with various embodiment of the present disclosure;

FIG. 5 illustrates a first assembly of a waste/recycling receptacle integrated with a waste/recycling receptacle protector/monitor to obtain the at least one objective for the individual, in accordance with various embodiment of the present disclosure;

FIG. 6 illustrates a second assembly of the waste/recycling receptacle integrated with the waste/recycling receptacle protector/monitor to obtain the at least one objective for the individual, in accordance with various embodiment of the present disclosure; and FIG. 7 illustrates a third assembly of the waste/recycling receptacle integrated with the waste/recycling receptacle protector/monitor to obtain the at least one objective for the individual, in accordance with various embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Reference will now be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

FIG. 1 illustrates a first perspective view of a tension adjustable fastening module 100 to obtain at least one objective for an individual, in accordance with various embodiment of the present disclosure. FIG. 2 illustrates a second perspective view of the tension adjustable fastening module 100 to obtain the at least one objective for the individual, in accordance with various embodiment of the present disclosure. FIG. 3 illustrates a third perspective view of the tension adjustable fastening module 100 to obtain the at least one objective for the individual, in accordance with various embodiment of the present disclosure. FIG. 4 illustrates a fourth perspective view of the tension adjustable fastening module 100 to obtain the at least one objective for the individual, in accordance with various embodiment of the present disclosure. The tension adjustable fastening module 100 has first and second opposing ends that adapt to extend along at least one direction of a lid 204 (Illustrated in FIG. 5, FIG. 6, FIG. 7) of a waste/recycling receptacle 202 (Illustrated in FIG. 5, FIG. 6, FIG. 7). The tension adjustable fastening module 100 breaks apart under a predetermined opposable force preset by the individual.

The tension adjustable fastening module 100 includes a retaining latch and a securing mechanism. In addition, the retaining latch has at least one strap 102 at first and second opposing ends of the retaining latch. Further, the retaining latch is configured for selectively setting between a manual mode, a semi-automatic mode or an automatic mode. Furthermore, the retaining latch includes a first fastener attached to the first end of the at least one strap 102 of the tension adjustable fastening module 100 and a second fastener attached to the second end of the at least one strap 102 of the tension adjustable fastening module 100. Moreover, the first fastener being matingly engageable with the second fastener.

The securing mechanism constructed and arranged to secure the retaining latch and the at least one strap 102 to the lid 204. The securing mechanism is governed by the predetermined opposable force preset by the individual. In addition, the tension adjustable fastening module 100 is constructed and arranged to maintain the lid 204 in a closed position and the first fastener and the second fastener are matingly engaged with each other in a first engaged position, and to release the lid 204 from the closed position when the first fastener and the second fastener are in a second non-engaged position.

The tension adjustable fastening module 100, which in the present embodiment, is positioned between the securing mechanism and exterior surface of the lid 204. Preferably, the securing mechanism is spaced apart from exterior surface sufficiently to the tension adjustable fastening module 100 to slide over the exterior surface of the lid 204. However, it is not necessary that the tension adjustable fastening module 100 must slide, and it may be fixed securely between the securing mechanism provided that the individual may still access the fasteners of the tension adjustable fastening module 100, which are discussed below. The tension adjustable fastening module 100 includes the retaining latch having the first fastener and the second fastener attached to each opposing end.

In an embodiment of the present disclosure, the first fastener and the second fastener are matingly engageable with each other. In another embodiment of the present disclosure, the first fastener and the second fastener may be any type of quick release fastener. In yet another embodiment of the present disclosure, the first fastener and the second fastener may be adjustable so as to allow the tension adjustable fastening module 100 to be adapted to different waste/recycling receptacles having a varying size.

In this manner, the tension adjustable fastening module 100 is retained and is prevented from sliding completely out of the space between the securing mechanism and the exterior of the lid 204. In the present embodiment, the first fastener and the second fastener are quick-release type fasteners, which have been found to be user-friendly for humans, but not for animals attempting to access the interior of the waste/recycling receptacle 202. Such quick-release type fasteners also have been found able to withstand extreme weather conditions without releasing. Although those of skill in the art will recognize that it is possible to include one or more than two separate retaining fastener(s) to provide a more secure or fallback situation, should one become damaged.

As explained in more detail below, the at least one strap 102 is configured to be coupled to the securing mechanism and tightly pulled over the lid 204 to secure the lid 204 to the waste/recycling receptacle 202. With reference to FIGS. 1, 2, 3 and 4, in one embodiment, the at least one strap 102 is a generally elongate flat member extending along a main axis and having opposed upper and lower surfaces and opposed first and second ends. In an embodiment of the present disclosure, the at least one strap 102 may be made from a flexible, non-stretchable fabric. In another embodiment of the present disclosure, the at least one strap 102 may be made from a flexible, stretchable fabric. In yet another embodiment of the present disclosure, the at least one strap 102 may be made from an inflexible, stretchable fabric. In yet another embodiment of the present disclosure, the at least one strap 102 may be made from an inflexible, non-stretchable fabric.

For example, and without limitation, the at least one strap 102 may be made of woven nylon, cotton, polyester, rubber, silicon, plastics or any other suitable material known to those of ordinary skill in the art capable of sufficiently securing the lid 204 in place against the waste/recycling receptacle 202 and resisting expected levels of wear and tear as well as animal and weather-induced damage.

The at least one strap 102 has the first fastener and the second fastener located on surface of the at least one strap 102, at each of the first and second ends. In an embodiment of the present disclosure, the at least one strap 102 has a width of about 1 inch. In another embodiment of the present disclosure, the width of the at least one strap 102 may vary. The at least one strap 102 is designed to either go over the top as shown here, or fastened to the front as pictured here.

The lid 204 is secured with an automated open may also be accomplished with the retaining latch (inside or outside) or a mechanical mechanism. The mechanical mechanism may include screws or other suitable fasteners (As shown in FIG. 4) to secure the lid 204. It is designed to have tension by constructed of elastic and adjustable. In an embodiment of the present disclosure, the tension adjustable fastening module 100 having the first and second opposing ends that adapt to extend along horizontal direction of the lid 204 of the waste/recycling receptacle 202. In another embodiment of the present disclosure, the tension adjustable fastening module 100 having the first and second opposing ends that adapt to extend along vertical direction of the lid 204 of the waste/recycling receptacle 202. In yet another embodiment of the present disclosure, the tension adjustable fastening module 100 having the first and second opposing ends that adapt to extend along diagonal direction of the lid 204 of the waste/recycling receptacle 202.

Further, the first fastener and the second fastener are made up of a material selected from a group of materials consisting rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

The waste/recycling receptacle 202 is integrated with the waste/recycling receptacle protector/monitor to obtain the at least one objective for the individual. In addition, the waste/recycling receptacle protector/monitor includes the tension adjustable fastening module 100. Further, the waste/recycling receptacle protector/monitor may include one or more thermal cameras, one or more day imagers, a plurality of sensors, a processor and a memory. The memory comprises instructions configured to cause the processor to obtain the at least one objective for the individual. The tension adjustable fastening module 100 has the first and second opposing ends that adapt to extend along the at least one direction of the lid 204 of the waste/recycling receptacle 202. Further, the tension adjustable fastening module 100, the one or more thermal cameras, the one or more day imagers and the plurality of sensors are coupled with the processor and the memory. Furthermore, the processor, the one or more thermal cameras, the one or more day imagers, and the plurality of sensors are located inside or around the waste/recycling receptacle 202.

The at least one objective includes protection against at least one of theft of the waste/recycling receptacle 202, natural climate, personal data theft, and unauthorized dumping into the waste/recycling receptacle 202, and surveillance of vicinity and one or more objects around the waste/recycling receptacle 202.

The waste/recycling receptacle 202 includes a container body, the lid 204 and an engagement member. In addition, the lid 204 connected to the container body through one or more mechanical means. The one or more mechanical means include but may not be limited to hinge mechanism, spring mechanism, nut & bolts, and at least one lock plunger. Further, the engagement member on an outer surface of the container body or the lid 204 to engage with the tension adjustable fastening module 100.

In an embodiment of the present disclosure, the lid 204 connected to the container body by at least one hinge, but those of ordinary skill in the art will understand that hinge is not necessary to the disclosure, and any mechanical means may be used. In an embodiment of the present disclosure, the container body is illustrated herein with a substantially circular shape. In another embodiment of the present disclosure, the container body is illustrated herein with a substantially square shape, but those of ordinary skill in the art will understand that a square shape is not necessary to the disclosure, and any shape may be used. The at least one hinge may be unitary, as illustrated, or they may be attached or integrally formed with the lid 204 and the container body. In addition, although illustrated with one hinge, any number of hinges or other means of connecting the lid 204 to the container body may be used.

In an embodiment of the present disclosure, the engagement member is attached on exterior surface of the container body to be coupled with the tension adjustable fastening module 100 to enable the retaining latch to secure the lid 204 to the container body. In another embodiment of the present disclosure, the engagement member is attached on interior surface of the container body to be coupled with the tension adjustable fastening module 100 to enable the retaining latch to secure the lid 204 to the container body. In yet another embodiment of the present disclosure, the engagement member is attached on exterior surface of the container body and the lid 204 to be coupled with the tension adjustable fastening module 100 to enable the retaining latch to secure the lid 204 to the container body. In yet another embodiment of the present disclosure, the engagement member is attached on exterior surface the lid 204 to be coupled with the tension adjustable fastening module 100 to enable the retaining latch to secure the lid 204 to the container body. In yet another embodiment of the present disclosure, the engagement member is attached on interior surface of the lid 204 and exterior surface of the container body to be coupled with the tension adjustable fastening module 100 to enable the retaining latch to secure the lid 204 to the container body.

The engagement member may be unitary or integrally formed with the waste/recycling receptacle 202. When it is attached, as in the present embodiment, the engagement member preferably couples with the tension adjustable fastening module 100 on opposing ends through which an attachment to any of the container body or lid 204 is made by a fastener. In an embodiment of the present disclosure, the fastener is illustrated herein as a rivet, but those of ordinary skill in the art will recognize that any suitable fastener may be used, such as a nut and bolt.

The waste/recycling receptacle protector/monitor may include the one or more thermal cameras. In general, thermal imaging camera is device that converts thermal energy of a particular object into visible light in order to analyze. In addition, the one or more thermal cameras include at least one of cooled thermal cameras and uncooled thermal cameras. In general, uncooled thermal camera requires less complex components and less maintenance.

The waste/recycling receptacle protector/monitor may include the one or more day imagers. In addition, the one or more day imagers include but may not be limited to at least one of colored cameras, omnidirectional cameras, and pan-tilt-zoom cameras. In general, colored camera is used for capturing the view in daytime. In general, omnidirectional cameras is a 360-degree camera. In addition, omnidirectional cameras have a field of view that covers entire sphere in horizontal plane. In general, PTZ camera is Pan-tilt-zoom camera. In addition, PTZ camera provides continuous optical zoom. Further, continuous optical zoom perform long range surveillance and tracking of the one or more objects around the waste/recycling receptacle 202. Furthermore, PTZ camera is used for surveillance, distance learning, live production and the like. In an embodiment of the present disclosure, the one or more day imagers records the one or more objects in vicinity of the waste/recycling receptacle 202 in real-time.

The waste/recycling receptacle protector/monitor may include the plurality of sensors. The plurality of sensors includes at least one of one or more tension sensors to release the retaining latch, one or more GPS sensors, one or more accelerometer sensors, one or more magnetometer sensors, one or more gyroscope sensors, one or more barometer sensors, one or more proximity sensors, one or more motion sensors, one or more microphones, one or more weather sensors, one or more thermal sensors, one or more wireless fidelity sensors, and one or more image sensors. In general, sensor is a device that detects and responds to some type of input from physical environment. In addition, output of sensor is a signal that is converted to human readable display. The plurality of sensors is installed at different locations of the waste/recycling receptacle 202. Further, the plurality of sensors includes CMOS (complementary metal oxide semiconductor) image sensor for the one or more day imagers. In general, CMOS imager is complementary metal oxide semiconductor imager. In addition, the low lux CMOS imager is used to convert charge from a photosensitive pixel to a voltage at the pixel site. Further, the signal is multiplexed by row and column to multiple on chip digital-to-analog converters (DACs). In general, digital to analog converter (DAC) converts a digital input signal into an analog output signal. In addition, the digital signal is represented with a binary code, which is a combination of bits 0 and 1. The plurality of sensors senses and detects the one or more objects present around the vicinity of the waste/recycling receptacle 202. In addition, the one or more objects include but may not be limited to trash pickup trucks, the lid 204, vehicles, trash and other wastes, trash dumping individual, pedestrians, animals, buildings, and birds.

The waste/recycling receptacle protector/monitor may be configured to connect with a communication device of the individual. The individual may control and monitor the waste/recycling receptacle protector/monitor through the communication device. In an embodiment of the present disclosure, the communication device facilitates access to the waste/recycling receptacle protector/monitor. In an embodiment of the present disclosure, the communication device is a portable communication device. The portable communication device include but may not be limited to a laptop, a smartphone, a tablet, and a smart watch. In an example, the smartphone may be an iOS-based smartphone, an android-based smartphone, a windows-based smartphone and the like. In another embodiment of the present disclosure, the communication device is a fixed communication device. The fixed communication device include but may not be limited to a desktop, a workstation, a smart TV and a mainframe computer. The communication device is any type of device having an active internet.

In an embodiment of the present disclosure, the communication device performs computing operations based on a suitable operating system installed inside the communication device to control the waste/recycling receptacle protector/monitor. In general, the operating system is system software that manages computer hardware and software resources and provide common services for computer programs. In addition, the operating system acts as an interface for software installed inside the communication device to interact with hardware components of the communication device. In an embodiment of the present disclosure, the communication device performs computing operations based on any suitable operating system designed for the portable communication device. In an example, the operating system installed inside the communication device is a mobile operating system. Further, the mobile operating system include but may not be limited to windows operating system, android operating system, iOS operating system, Symbian operating system, bada operating system from Samsung Electronics and BlackBerry operating system, and sailfish. However, the operating system is not limited to above mentioned operating systems. In an embodiment of the present disclosure, the communication device operates on any version of particular operating system corresponding to above mentioned operating systems.

In another embodiment of the present disclosure, the communication device performs computing operations based on any suitable operating system designed for fixed communication device. In an example, the operating system installed inside the communication device is windows. In another example, the operating system installed inside the communication device is Mac. In yet another example, the operating system installed inside the communication device is Linux based operating system. In yet another example, the operating system installed inside the communication device is Chrome OS. In yet another example, the operating system installed inside the communication device may be one of UNIX, Kali Linux, and the like. However, the operating system is not limited to above mentioned operating systems.

In an embodiment of the present disclosure, the communication device operates on any version of windows operating system. In another embodiment of the present disclosure, the communication device operates on any version of Mac operating system. In yet another embodiment of the present disclosure, the communication device operates on any version of Linux operating system. In yet another embodiment of the present disclosure, the communication device operates on any version of Chrome OS. In yet another embodiment of the present disclosure, the communication device operates on any version of particular operating system corresponding to above mentioned operating systems.

The communication device is connected to a communication network. The communication network provides a medium for the individual to control and operate the waste/recycling receptacle protector/monitor through the communication device. In an embodiment of the present disclosure, the communication network is an internet connection. In another embodiment of the present disclosure, the communication network is a wireless mobile network. In yet another embodiment of the present disclosure, the communication network is a wired network with a finite bandwidth. In yet another embodiment of the present disclosure, the communication network is a combination of the wireless and the wired network for the optimum throughput of data transmission. In yet another embodiment of the present disclosure, the communication network is an optical fiber high bandwidth network that enables a high data rate with negligible connection drops. The communication network includes a set of channels. Each channel of the set of channels supports a finite bandwidth. Moreover, the finite bandwidth of each channel of the set of channels is based on capacity of the communication network. The communication network connects the communication device to the waste/recycling receptacle protector/monitor using a plurality of methods. The plurality of methods used to provide network connectivity to the communication device includes 2G, 3G, 4G, 5G, Wifi and the like.

The waste/recycling receptacle protector/monitor may further include a power supply to run one or more electronic and electric modules located inside or around the waste/recycling receptacle 202. The one or more electronic and electric modules include but may not be limited to the processor, the memory, the plurality of sensors, the securing mechanism, the retaining latch, the one or more thermal cameras and the one or more day imagers. The waste/recycling receptacle protector/monitor may be operated through at least one of a touch screen installed on the waste/recycling receptacle 202, a keypad 206 installed on the waste/recycling receptacle 202 or remotely using the communication device of the individual. Data received/collected from the plurality of sensors, the one or more thermal cameras and the one or more day imagers enables trigger of the tension adjustable fastening module 100 to maintain the lid 204 in the closed position through the first fastener and the second fastener matingly engaged with each other in the first engaged position, and to release the lid 204 from the closed position when the first fastener and the second fastener are in the second non-engaged position.

The waste/recycling receptacle protector/monitor may include a processor. The processor can execute instructions within the waste/recycling receptacle protector/monitor, including the instructions stored in the memory. The processor may be implemented as a chipset of chips that include separate and multiple analog and digital processors. The processor may provide, for example, for coordination of the other components of the waste/recycling receptacle protector/monitor. The processor may communicate with the individual through control interface and display interface coupled to a display. The display may be, for example, a TFT LCD (Thin-Film-Transistor Liquid Crystal Display) or an OLED (Organic Light Emitting Diode) display, or other appropriate display technology. The display interface may comprise appropriate circuitry for driving the display to present graphical and other information to the individual. The control interface may receive commands from the individual and convert them for submission to the processor. In addition, an external interface may be provided in communication with the processor, to enable near area communication of the waste/recycling receptacle protector/monitor with other devices such as the communication device. External interface may provide, for example, for wired communication in some implementations, or for wireless communication in other implementations, and multiple interfaces may also be used.

The memory stores information within the waste/recycling receptacle protector/monitor. The memory can be implemented as one or more of a computer-readable medium or media, a volatile memory unit or units, or a non-volatile memory unit or units. Expansion memory may also be provided and connected to the waste/recycling receptacle protector/monitor through expansion interface, which may include, for example, a SIMM (Single In Line Memory Module) card interface. Such expansion memory may provide extra storage space for the waste/recycling receptacle protector/monitor, or may also store applications or other information for the waste/recycling receptacle protector/monitor. Specifically, expansion memory may include instructions to carry out or supplement the processes described above, and may include secure information also. Thus, for example, expansion memory may be provide as a security module for the waste/recycling receptacle protector/monitor, and may be programmed with instructions that permit secure use of the waste/recycling receptacle protector/monitor. In addition, secure applications may be provided via the SIMM cards, along with additional information, such as placing identifying information on the SIMM card in a non-hackable manner. The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory, expansion memory, or memory on processor, that may be received, for example, over transceiver or external interface.

FIG. 5 illustrates a first assembly 200 of the waste/recycling receptacle 202 integrated with the waste/recycling receptacle protector/monitor to obtain the at least one objective for the individual, in accordance with various embodiment of the present disclosure. In addition, the first assembly 200 includes the waste/recycling receptacle 202, the lid 204, and the waste/recycling receptacle protector/monitor including the power source run the keypad 206 to enable trigger of the tension adjustable fastening module 100 to maintain the lid 204 in the closed position through the first fastener and the second fastener matingly engaged with each other in the first engaged position, and to release the lid 204 from the closed position when the first fastener and the second fastener are in the second non-engaged position.

FIG. 6 illustrates a second assembly 300 of the waste/recycling receptacle 202 integrated with the waste/recycling receptacle protector/monitor to obtain the at least one objective for the individual, in accordance with various embodiment of the present disclosure. In addition, the second assembly 300 includes the waste/recycling receptacle 202, the lid 204, and the waste/recycling receptacle protector/monitor including a manual timer to enable trigger of the tension adjustable fastening module 100 to maintain the lid 204 in the closed position through the first fastener and the second fastener matingly engaged with each other in the first engaged position, and to release the lid 204 from the closed position when the first fastener and the second fastener are in the second non-engaged position.

FIG. 7 illustrates a third assembly 400 of the waste/recycling receptacle 202 integrated with the waste/recycling receptacle protector/monitor to obtain the at least one objective for the individual, in accordance with various embodiment of the present disclosure. In addition, the third assembly 400 includes the waste/recycling receptacle 202, the lid 204, and the waste/recycling receptacle protector/monitor including a stretchable fastening module 404 to maintain the lid 204 in the closed position through the first fastener and the second fastener 402 matingly engaged with each other in the first engaged position, and to release the lid 204 from the closed position when the first fastener and the second fastener 402 are in the second non-engaged position.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

I claim:

1. A waste/recycling receptacle protector/monitor for obtaining at least one objective for an individual, the waste/recycling receptacle protector/monitor comprising:

a tension adjustable fastening module, wherein the tension adjustable fastening module has first and second opposing ends that adapt to extend along at least one direction of a lid of a waste/recycling receptacle, wherein the tension adjustable fastening module breaks apart under a predetermined opposable force preset by the individual, wherein the tension adjustable fastening module comprising:

a retaining latch having at least one strap at first and second opposing ends of the retaining latch, wherein the retaining latch comprises a first fastener attached to the first end of the at least one strap of the tension adjustable fastening module and a second fastener attached to the second end of the at least one strap of the tension adjustable fastening module, the first fastener being matingly engageable with the second fastener; and a securing mechanism constructed and arranged to secure the retaining latch and the at least one strap to the lid.

2. The waste/recycling receptacle protector/monitor as recited in claim 1, wherein the at least one objective comprising:

protection against at least one of theft of the waste/recycling receptacle, natural climate, personal data theft, and unauthorized dumping into the waste/recycling receptacle; and surveillance of vicinity and one or more objects around the waste/recycling receptacle.

3. The waste/recycling receptacle protector/monitor as recited in claim 1, wherein the waste/recycling receptacle comprising:

a container body;

the lid connected to the container body through one or more mechanical means; and an engagement member on an outer surface of the container body or the lid to engage with the tension adjustable fastening module.

4. The waste/recycling receptacle protector/monitor as recited in claim 1, wherein the retaining latch may be configured for selectively setting between a manual mode, a semi-automatic mode or an automatic mode, wherein the securing mechanism is governed by the predetermined opposable force preset by the individual, wherein the tension adjustable fastening module is constructed and arranged to maintain the lid in a closed position and the first fastener and the second fastener are matingly engaged with each other in a first engaged position, and to release the lid from the closed position when the first fastener and the second fastener are in a second non-engaged position.

5. The waste/recycling receptacle protector/monitor as recited in claim 1, wherein the waste/recycling receptacle protector/monitor may comprise one or more thermal cameras, one or more day imagers, a plurality of sensors, a processor, and a memory, wherein the memory comprises instructions configured to cause the processor to obtain the at least one objective for the individual, wherein the tension adjustable fastening module, the one or more thermal cameras, the one or more day imagers and the plurality of sensors are coupled with the processor and the memory, wherein the processor, the one or more thermal cameras, the one or more day imagers, and the plurality of sensors are located inside or around the waste/recycling receptacle, wherein the one or more thermal cameras comprising at least one of cooled thermal cameras and uncooled thermal cameras, wherein the one or more day imagers comprising at least one of coloured cameras, omnidirectional cameras, and pan-tilt-zoom cameras, wherein the plurality of sensors comprising at least one of one or more tension sensors to release a retaining latch, one or more GPS sensors, one or more accelerometer sensors, one or more magnetometer sensors, one or more gyroscope sensors, one or more barometer sensors, one or more proximity sensors, one or more motion sensors, one or more microphones, one or more weather sensors, one or more thermal sensors, one or more wireless fidelity sensors, and one or more image sensors.

6. The waste/recycling receptacle protector/monitor as recited in claim 1, wherein the waste/recycling receptacle protector/monitor may be configured to connect with a communication device of the individual.

7. The waste/recycling receptacle protector/monitor as recited in claim 1, wherein the waste/recycling receptacle protector/monitor may comprise a power supply to run one or more electronic and electric modules located inside or around the waste/recycling receptacle.

8. The waste/recycling receptacle protector/monitor as recited in claim 1, wherein the waste/recycling receptacle protector/monitor may be operated through at least one of a touch screen installed on the waste/recycling receptacle, a keypad installed on the waste/recycling receptacle or remotely using a communication device of the individual.

* * * * *